United States Patent [19]

Schwarzbach et al.

[11] 4,177,661

[45] Dec. 11, 1979

[54] METHOD AND APPARATUS FOR BENDING LARGE PIPES

[75] Inventors: Kurt Schwarzbach, Düsseldorf; Horst Koehler, Haan; Franz Müller, Duisburg, all of Fed. Rep. of Germany

[73] Assignee: Mannesmann Aktiengesellschaft, Dusseldorf, Fed. Rep. of Germany

[21] Appl. No.: 748,216

[22] Filed: Dec. 7, 1976

[30] Foreign Application Priority Data

Dec. 5, 1975 [DE] Fed. Rep. of Germany ..... 2555326

[51] Int. Cl.[2] ..... B21D 7/024; B21D 7/16

[52] U.S. Cl. ..... 72/128; 72/369

[58] Field of Search ..... 72/128, 149, 202, 342, 72/364, 369; 219/8.5, 10.43, 153, 156

[56] References Cited

U.S. PATENT DOCUMENTS

| | | | |
|---|---|---|---|
| 1,891,338 | 12/1932 | Snell | 72/128 |
| 1,996,838 | 4/1935 | Snell | 72/128 |
| 2,461,323 | 2/1949 | Hille | 72/342 |
| 2,480,315 | 8/1949 | Bennett | 219/153 |
| 3,740,991 | 6/1973 | Walraven et al. | 72/342 |

FOREIGN PATENT DOCUMENTS

| | | | |
|---|---|---|---|
| 973915 | 7/1949 | Fed. Rep. of Germany | 219/10.43 |
| 940865 | 3/1956 | Fed. Rep. of Germany | 72/342 |
| 1527290 | 1/1970 | Fed. Rep. of Germany | 72/128 |
| 43-8199 | 3/1968 | Japan | 72/150 |
| 778842 | 7/1957 | United Kingdom | 72/154 |
| 816625 | 7/1959 | United Kingdom | 72/342 |
| 965604 | 8/1964 | United Kingdom | 72/128 |

*Primary Examiner*—E. M. Combs

*Attorney, Agent, or Firm*—Smyth, Pavitt, Siegemund, Jones & Martella

[57] ABSTRACT

A process for bending large pipes comprises the steps of progressively and inductively heating the wall of a pipe within the region to be bent. The penetration depth of the heat energy is varied over the circumference of the pipe through shielding. The inner radius of the pipe to be heated may initially be heated before the entire wall is differentially heated. Apparatus for carrying out the process is also disclosed.

4 Claims, 3 Drawing Figures

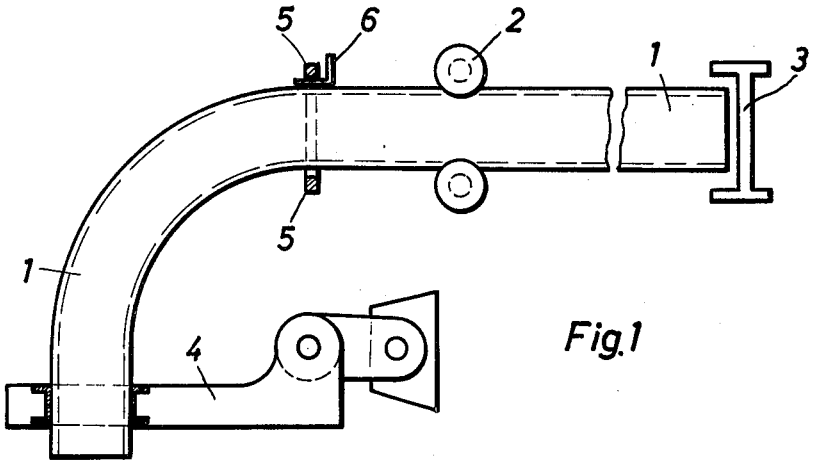
Fig.1
Fig.2
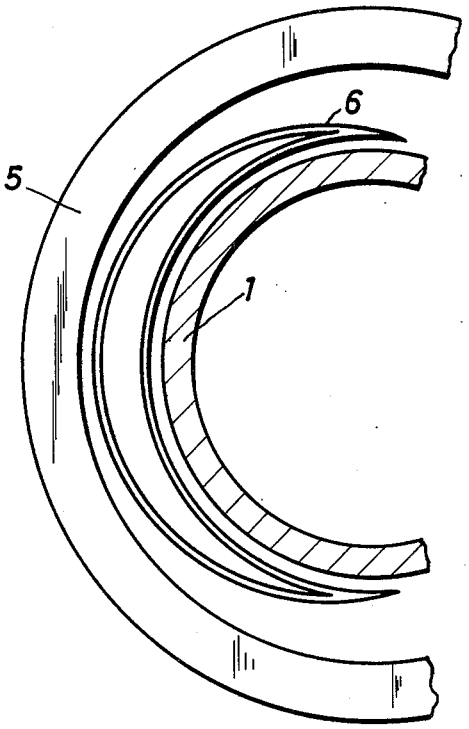
Fig.3
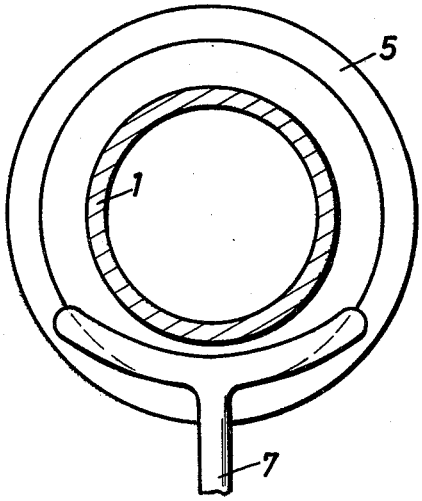

METHOD AND APPARATUS FOR BENDING LARGE PIPES

BACKGROUND OF THE INVENTION

The present invention relates to bending large pipes by differentially heating the wall of the pipe within the region of the wall to be bent.

It is known to manufacture curved pipes in that a straight pipe is heated at the desired place of intended bending and is continuously bent along a circular line; see for example German published application No. 1,527,290. It is further known to prepare pipes for bending by means of a heating device being disposed behind a guiding and transport device and being movable to heat the pipe over a small cross-sectional region in each instant. In this case, the bending radius is determined by a swingable bending arm; see German published application No. 2,112,019.

It has also been proposed to dispose the heating device eccentrically in order to heat the pipe wall differentially. In this manner, it was attempted to reduce the weakening of the pipe wall at the outer radius of the curvature.

By means of the known process, it was not possible to obtain an optimum result with respect to the desired wall thickness. Therefore, pipes had to be used frequently which had to have a thicker wall at the outside in order to obtain the desired wall thickness in the finished pipe curvature.

SUMMARY OF THE INVENTION

It is accordingly an object of the invention to provide a process and a device for bending large pipes which includes differential heating of the region of the pipe to be bent in order to achieve uniform wall thicknesses.

It is a specific object of the present invention to improve a pipe bending method including the pushing of a pipe through a heating station and bending the pipe by means of a bending lever which grips the end of the pipe and pivots as the pipe progresses.

In accordance with the present invention, it is suggested to bend large pipes in that the pipe is inductively heated, progressively just prior to bending and the pipe wall is heated differentially either through varying the penetration depth of the heat energy over the circumference of the pipe or by supplementing the heating locally ahead of the region of circumferential inductive heating. In either case, the pipe passes concentrically through an annular inductive heater.

Due to the process in accordance with the invention as well as the apparatus, it is possible for every pipe diameter or for every wall thickness to carry out a differential heating of the pipe region to bent. As a result the finally bent pipe has a cross-section with a uniform wall thickness over its circumference.

It should be noted that for the individual manufacture of bent pipes, there is the possibility to carry out the process of the invention so that within a certain region of the circumference of the pipe sheet metal plates of predetermined dimensions and thicknesses may be secured, for example, by spot welding.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a plan view of an apparatus and machine for bending large pipes in accordance with the preferred embodiment of the present invention;

FIG. 2 is a cross-sectional view on enlarged scale of the apparatus of FIG. 1 ahead of the heating device; and FIG. 3 is a cross-sectional view of the heaters in a pipe bending device.

Proceeding now to the detailed description of the drawings, FIG. 1 shows a pipe that has actually been bent. The pipe is disposed in a guidance holding and transport device 2. The free end of the pipe is clamped to a turning lever 4. The pipe is advanced during the bending by means of pressure element 3. The heat source may be comprised, for example, of annular induction coils 5 heating in each instant a predetermined axial length of the pipe. The heat source is concentrically arranged to the pipe and is disposed between the guidance device 2 and the bending lever 4.

A screen or shield 6 is disposed between the guidance device 2 and the heat source 5. The shield is movable in the direction of the axis of the (unbent) pipe. The shield 6 is also rotatable about the axis of the pipe. The screen or shield 6 can be placed specifically between the wall of the pipe and the heating device 5, and it extends beyond that heating device. The screen 6 is placed adjacent to that portion of the pipe which is to be heated less, and particularly less deep.

In operation, arm 4 is initially in an upright position and the one end of pipe 1 is clamped thereto. As device 3 pushes the pipe in the direction for passage through heater 5, arm 4 begins to turn counterclockwise to bend the pipe. The portion of the pipe to be bent is passed progressively through heater 5 whereby the shield 6 diminishes the heating of the pipe along that portion that will assume the largest radius of curvature.

As illustrated in FIG. 2, the cross-section of the ends of the shield 6 are tapered, that is they are crescent-shaped in order to provide a better and gradual transition in the wall of the pipe to the unshielded portion thereof. For ease of illustration, shield 6 is shown in FIG. 2 in a position that is 90° out of the position it will have during bending. It covers effectively almost half of the pipes circumference. It was found that the shield should cover at least about one third of the pipe's periphery.

The modified apparatus illustrated in FIG. 3 is disposed ahead of the annular heat source 5 and includes a heat source 7 of generally linear shape. This heat source 7 acts upon the wall portion of the inner curvature of the pipe being bent prior to overall heating by source 5. In other words, the inside portion of the pipe being bent is pre-heated ahead of application of heat through the annular heater 5.

In either case, it can be seen that the pipe is heated more along the inside curvature of the bent configuration to be made than on the outside.

The invention is not limited to the embodiments described above but all changes and modifications thereof not constituting departures from the spirit and scope of the invention are intended to be included.

We claim:

1. Apparatus for bending large pipes including:

(a) a guidance device for guiding a pipe to be bent;

(b) a pressure element for pushing the pipe through said guidance device;

(c) a heat source placed downstream from the guidance device in a direction of movement of the pipe for inductively heating the pipe, said heating source being of annular shape;

(d) a turning lever for receiving and holding the free end of the pipe during bending, the improvement comprising:

(e) a screen disposed between said heating source and said guidance device but not mounted on the pipe, said screen being movable in the direction of the axis of the pipe to be bent and being disposed between the wall of the pipe and said annular heat source opposite to the location of the turning axis of the lever about which the pipe is being bent, said screen being shaped to cover less than the full circumference of the pipe but at least approximately one third of the circumference of the pipe and having maximum thickness adjacent to a line of largest curvature of the bending and turning, and tapering down adjacent to sides of the pipe undergoing medium curving upon bending, said screen being stationary relative to the pipe during bending by operation of turning of the lever.

2. Apparatus as defined in claim 1, wherein said screen extends over approximately one-half of the circumference of the pipe, the cross-section of said screen being crescent-shaped.

3. Apparatus for bending large pipes comprising:

(a) a device for guiding a pipe to be bent and causing it to move in a particular direction;

(b) a pressure element for pushing the pipe through said guidance device;

(c) a first inductive heater of substantially linear shape disposed downstream from said guidance device in the direction of movement of the pipe, said linear heat source being disposed in the region of the inner radius of the pipe to be bent and spaced at a minimum distance from a line shaped region of the pipe and gradually increasing in distance from the pipe in both circumferential directions from that line-shaped region, to reduce penetration depth of inductive heating;

(d) a second inductive heater of substantially annular shape disposed downstream from the first linear heat source in the direction of movement of the pipe for uniformly heating the pipe at uniform penetration depth; and (e) a turning lever for receiving and holding the free end of the pipe during bending.

4. In a process for bending large pipes comprising the steps of inductively heating the wall of the pipe by passing it concentrically through an annular inductive heating device; and shielding the pipe as it passes through the heating device by means of a stationary shielding device to axially uninterruptedly shield that part of the circumference of the pipe which will be bent at the large radius of curvature, from a full application of inductive energy by the annular heating thereby reducing the penetration depth of the inductive heating the shielding tapering off towards portions being bent at a medium curving while permitting other, axially uninterrupted parts of the pipe to be fully exposed to the application of inductive heating, said other parts undergoing bending at a still smaller radius of curvature.

* * * * *